US010023332B2

(12) United States Patent
Gamberini et al.

(10) Patent No.: US 10,023,332 B2
(45) Date of Patent: Jul. 17, 2018

(54) CONTINUOUS ROTARY MACHINE FOR FILLING CAPSULES WITH PHARMACEUTICAL PRODUCTS

(71) Applicant: MG 2-S.r.l., Pianoro (IT)

(72) Inventors: Ernesto Gamberini, Rastignano (IT); Davide Nannetti, Quarto Inferiore (IT)

(73) Assignee: MG2-S.R.L., Pianoro (IT)

( * ) Notice: Subject to any disclaimer, the term of this patent is extended or adjusted under 35 U.S.C. 154(b) by 951 days.

(21) Appl. No.: 14/255,385

(22) Filed: Apr. 17, 2014

(65) Prior Publication Data

US 2014/0311104 A1 Oct. 23, 2014

(30) Foreign Application Priority Data

Apr. 19, 2013 (IT) ..... BO2013A0178

(51) Int. Cl.

| | |
|---|---|
| ***B65B 1/32*** | (2006.01) |
| ***B65B 1/06*** | (2006.01) |
| ***B65B 7/28*** | (2006.01) |
| ***A61J 3/07*** | (2006.01) |

(52) U.S. Cl.

CPC ..... *B65B 1/32* (2013.01); *A61J 3/074* (2013.01); *B65B 1/06* (2013.01); *B65B 7/28* (2013.01); *A61J 2200/74* (2013.01)

(58) Field of Classification Search

None

See application file for complete search history.

(56) References Cited

U.S. PATENT DOCUMENTS 2,764,863 A * 10/1956 Kath ..... A61J 3/074 141/110
3,601,954 A 8/1971 Aronson
3,978,640 A 9/1976 Crossley
(Continued)

FOREIGN PATENT DOCUMENTS

JP 2007182260 7/2007
JP 2008264549 11/2008
(Continued)

OTHER PUBLICATIONS

Italian Search Report for Corresponding Application No. IT BO2013 0178.

(Continued)

*Primary Examiner* — Hemant M Desai
*Assistant Examiner* — Tanzim Imam
(74) *Attorney, Agent, or Firm* — Gottlieb, Rackman & Reisman, PC

(57) ABSTRACT

A continuous rotary machine for filling capsules with pharmaceutical products is provided with at least one dosing wheel having a plurality of pockets each defined by a respective upper seat, which is suited to receive and hold a closing cap of a capsule and by a respective lower seat, which is suited to receive and hold a bottom of the capsule, and is provided with a measuring device to measure the weight of the bottom or of the bottom and of the pharmaceutical product contained in the lower seat itself; the upper seat being radially mobile between a forward position, in which the lower and the upper seats are vertically aligned with each other, and a retracted position, in which the lower and the upper seats are vertically staggered with respect to each other.

17 Claims, 9 Drawing Sheets

(56) References Cited

U.S. PATENT DOCUMENTS

| | | | | |
|---|---|---|---|---|
| 5,626,171 | A * | 5/1997 | Mirri | A61J 3/074 141/145 |
| 6,327,835 | B1 * | 12/2001 | Trebbi | A61J 3/074 53/507 |
| 6,390,330 | B2 * | 5/2002 | Runft | A61J 3/074 141/146 |
| 7,640,953 | B2 * | 1/2010 | Ansaloni | A61J 3/074 141/144 |
| 7,726,101 | B2 * | 6/2010 | Frabetti | A61J 3/074 141/83 |
| 2001/0035431 | A1 * | 11/2001 | Runft | A61J 3/074 222/168.5 |
| 2007/0062164 | A1 * | 3/2007 | Gamberini | B65G 47/525 53/502 |
| 2008/0056866 | A1 * | 3/2008 | Ansaloni | A61J 3/074 414/426 |
| 2008/0127609 | A1 * | 6/2008 | Tagliavini | A61J 3/074 53/53 |
| 2008/0141621 | A1 * | 6/2008 | Funaro | A61J 3/072 53/138.1 |
| 2010/0078093 | A1 * | 4/2010 | Ansaloni | A61J 3/074 141/284 |
| 2010/0192523 | A1 * | 8/2010 | Stoeckel | A61J 3/074 53/503 |
| 2011/0023414 | A1 * | 2/2011 | Ansaloni | A61J 3/074 53/281 |
| 2011/0146843 | A1 * | 6/2011 | Ansaloni | A61J 3/074 141/369 |
| 2011/0259468 | A1 * | 10/2011 | Bedetti | A61J 3/074 141/1 |

FOREIGN PATENT DOCUMENTS

| | | |
|---|---|---|
| JP | 2011143244 | 7/2011 |
| WO | 01/70171 | 9/2001 |
| WO | 2005112868 | 12/2005 |

OTHER PUBLICATIONS

Japan Patent Office, Notice of Reasons of Rejection, Corresponding Patent Application No. 2014-086744; dated Mar. 15, 2018.

* cited by examiner

CONTINUOUS ROTARY MACHINE FOR FILLING CAPSULES WITH PHARMACEUTICAL PRODUCTS

The present invention relates to a continuous rotary machine for filling capsules with pharmaceutical products.

BACKGROUND OF THE INVENTION

In the pharmaceutical industry, it is known to provide a continuous rotary machine of the type comprising a dosing wheel, which is mounted so as to rotate in a continuous manner around a substantially vertical rotation axis, and is provided with a plurality of pockets, which are distributed around the rotation axis, each for receiving a respective capsule, and are fed by the dosing wheel through an input station of the empty capsules in the respective pockets and an output station of the filled capsules from the respective pockets themselves.

During the transfer from the input station to the output station, each capsule is first of all opened and then filled with at least one pharmaceutical product, and is then closed again.

The dosing wheel comprises a container, which houses on its inside the pharmaceutical product, is mounted above the pockets, and extends around a longitudinal axis parallel to, and distinct from, said rotation axis; a feeding disc coaxial with the rotation axis; a plurality of pick and place arms, which are equal in number to the number of the pockets, are uniformly distributed around the rotation axis, and are mounted below the feeding disc.

Each pocket comprises an upper seat formed through the feeding disc and which is suited to receive and hold the closing cap of a respective capsule, and a lower seat, which is formed through a respective pick and place arm, which is suited to receive and hold the bottom of the capsule itself, and is radially mobile with respect to the feeding disc, between a retracted position, wherein the lower seat is vertically aligned to the upper seat to allow opening and closing of the capsule, and a forward position, in which the lower seat is vertically staggered with respect to the upper seat to allow the filling of the bottom.

The dosing wheel further comprises a plurality of dosing devices, which are equal in number so the number of pockets, are uniformly distributed around the rotation axis, and are fed by the dosing wheel primarily through a drawing station in which a given quantity of pharmaceutical product is drawn from the container and then in phase with a respective bottom to transfer the pharmaceutical product into the bottom itself.

Since the bottoms of the capsules are housed in the lower seats of the pick and place arms and the pick and place arms are radially mobile between their retracted and forward positions, continuous rotary machines known of the type described above have some drawbacks, mainly due to the fact that the lower seats may not be equipped with auxiliary devices provided with electrical wiring, which would be continually solicited by the radial displacements of the pick and place arms.

SUMMARY OF THE INVENTION

It is an object of the present invention to provide a continuous rotary machine for filling capsules with pharmaceutical products which is free from the drawbacks described above and which is simple and cheap to implement.

According to the present invention a continuous rotary machine for filling capsules with pharmaceutical products as claimed in the appended claims is provided.

BRIEF DESCRIPTION OF THE DRAWINGS

The present invention will now be described with reference to the accompanying drawings, which illustrate a non-limiting embodiment, wherein.

DETAILED DESCRIPTION OF THE INVENTION

Figure 1:
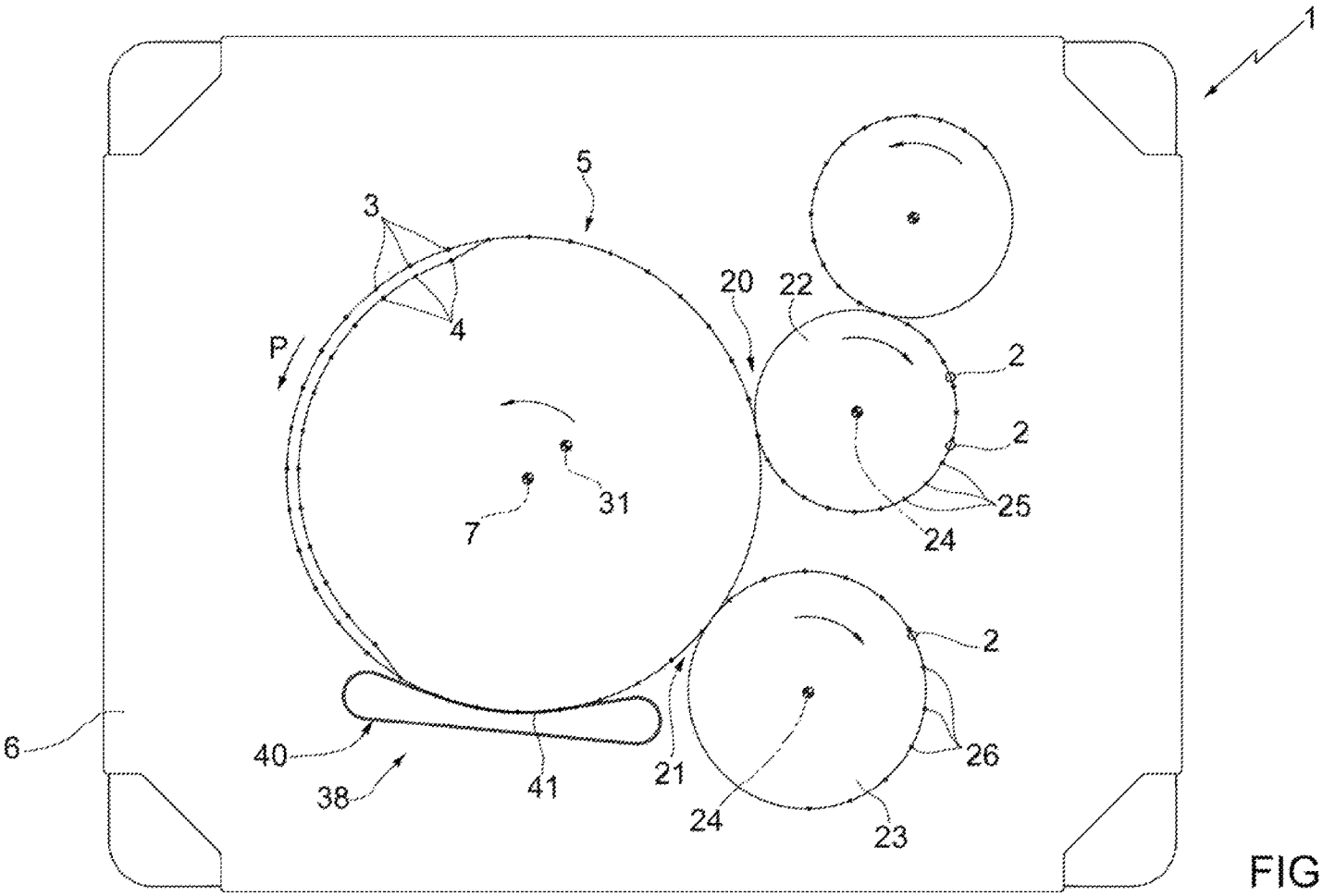
FIG. 1 is a schematic plan view, with parts removed for clarity, of a preferred embodiment of the rotary machine of the present invention.

With reference to FIGS. 1 and 2, with 1 is shown, as a whole, a continuous rotary machine for filling capsules 2 with pharmaceutical products. Each capsule 2 comprises a bottom 3 and a closing cap 4 of the bottom 3 itself (FIG. 2*a*).

The machine 1 comprises a first dosing wheel 5, which is mounted on a fixed frame 6 so as to rotate in a continuous manner, with respect to the frame 6 and under the thrust of a known actuating device not shown, around a respective rotation axis 7 (FIG. 1) substantially vertical and perpendicular to the plane of the sheet of FIG. 1, comprises a lower feeding disc 8 mounted coaxially with axis 7, and is provided with a plurality of upper pick and place units 9 uniformly distributed around the axis 7 itself.

The disc 8 is provided with a plurality of substantially cylindrical lower seats 10, which are uniformly distributed along the periphery of the disc 8, are equal in number to the number of the units 9, are formed through the disc 8 in a vertical direction 11 parallel to the axis 7, have respective longitudinal axes 12 parallel to the direction 11, and are suited so as to receive and hold, each, a respective bottom 3 arranged with its concavity facing upwards.

Each seat 10 is bounded laterally by a bushing 13, which is mounted inside the seat 10 coaxially to the respective axis 12, and is provided with a capacitive transducer 14, which is integrated in the bushing 13, and defines part of a measuring device 15 to measure the weight of the bottom 3 or of the bottom 3 and of the pharmaceutical product in turn contained in the seat 10 itself.

To each bushing 13 a plurality of interchangeable reduction sleeves (not shown) is associated, which are selectively inserted within the bushing 13 itself according to the size of the capsules 2.

The device 15 comprises, furthermore, an electrical connector known and not illustrated, which is mounted coaxially with the axis 7, and comprises, in turn, a fixed element mounted on the frame 6 and a mobile element fixed to the disc 8 and electrically connected with the capacitive transducers 14 of the seats 10.

The bushing 13, the capacitive transducer 14, and the measuring device 15 are described and illustrated in patent application WO-2006/035285-A2 of the same Applicant, the content of which is fully incorporated in the present patent application.

Each unit 9 comprises a support arm 16, which extends radially outwards, is mounted above the disc 8, is fed by the wheel 5 around the axis 7, and is coupled in a sliding manner to the disc 8 to perform, with respect to the disc 8 itself, radial displacements transverse to the direction 11 under the thrust of a cam actuating device (not shown) comprising a cam extending around the axis 7, and for each arm 16, a respective tappet roller engaged in the cam itself.

Each arm 16 is provided with a pick and place head 17, which is fixed at a free end of the arm 16, and is provided with an upper seat 18, which is associated with a corresponding seat 10, is formed through the head 17 in direction 11, and is suited to receive and hold a cap 4 arranged with its concavity facing downwards.

Each seat 18 comprises an enlarged upper portion 18*a* and a restricted lower portion 18*b*, and defines, together with the corresponding seat 10, a pocket 19 for a respective capsule 2.

The seat 18 is moved radially by the respective arm 16 between a forward position, in which the seat 18 is substantially aligned with the corresponding seat 10 in the direction 11, and a retracted position, in which the seat 18 is staggered with respect to the corresponding seat 10 in the direction 11 itself.

The pockets 19 are fed by wheel 5 around the axis 7 (counterclockwise in FIG. 1) and along a substantially circular path P, which extends around the axis 7 and through an input station 20 of the empty capsules 2 in the pockets 19 and an output station 21 of the filled capsules 2 of the pockets 19 themselves.

The wheel 5 is connected, at the station 20, with a wheel 22 for feeding the empty capsules 2 to the pockets 19 and, at the station 21, with a wheel 23 for drawing the filled capsules 2 from the pockets 19 themselves.

Each wheel 22, 23 is mounted so as to rotate in a continuous manner, with respect to the frame 6 and under the thrust of a known actuating device not shown, around a respective rotation axis 24 (FIG. 1) parallel to the direction 11, and is arranged in a containing plane extending over the pockets 19.

Figure 2A:
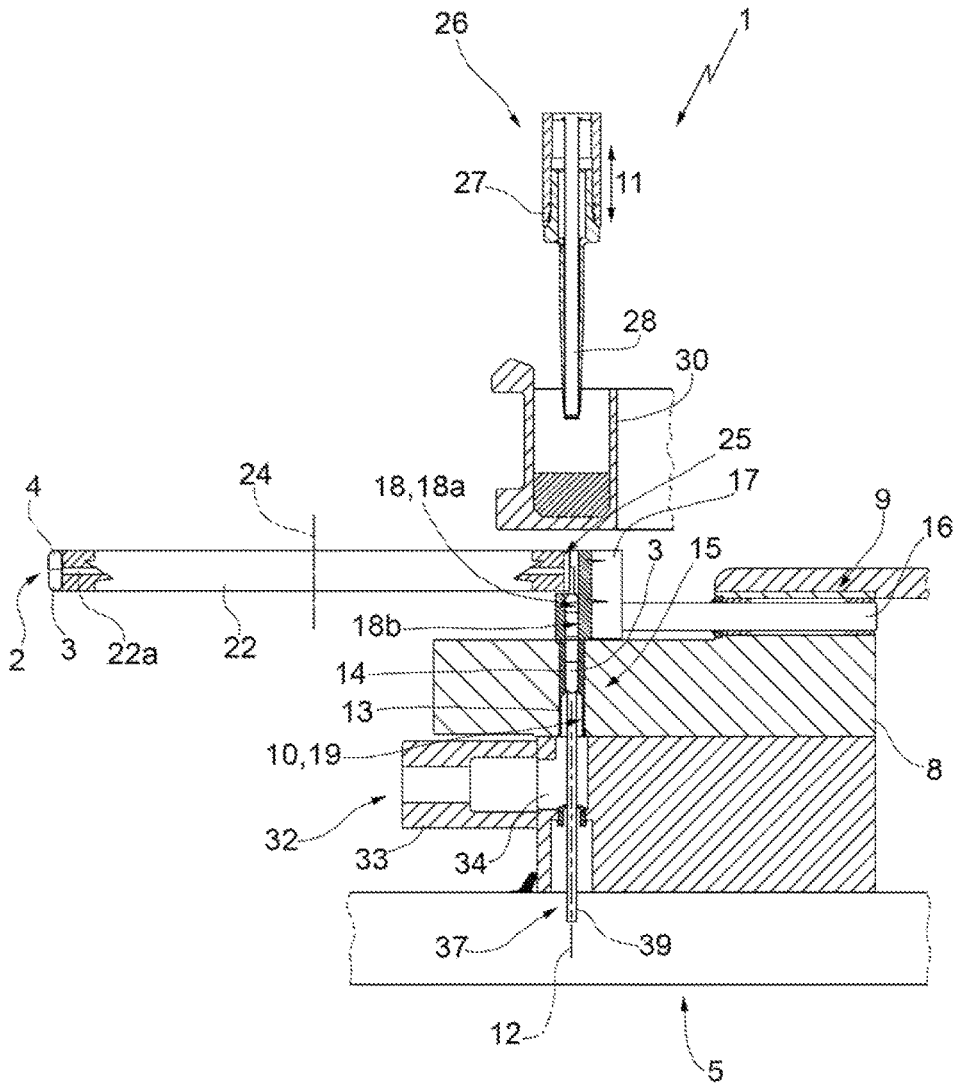
FIGS. 2*a* to 2*h* are eight schematic side views, with parts in section and parts removed for clarity, of a detail of the machine of FIG. 1 shown in eight different operating positions.

Each wheel 22, 23 has a plurality of seats 25, which are uniformly distributed around the axis 24, are formed along a peripheral edge of the wheel 22, 23, have a substantially semi-cylindrical shape, and are radially outwardly open. The seats 25 of the wheels 22, 23 are connected with respective pneumatic suction devices 22*a*, 23*a* in order to hold by suction the empty capsules 2 (FIG. 2*a*) and, respectively, the filled capsules 2 (FIG. 2*l*).

The wheel 5 is provided, also, with a plurality of dosing devices 26, which are equal in number to the number of pockets 19, and are each associated to a corresponding pocket 19.

Each device 26 comprises a dosing cylinder 27, which is mounted coaxially to the respective axis 12, is coupled in an angularly fixed and axially sliding manner to the disc 8 to perform, with respect to disc 8 and under the thrust of a cam actuating device not shown, rectilinear displacements in the direction 11, and is engaged in a sliding manner by a dosing piston 28 coupled in angularly fixed and axially sliding manner to the disc 8 to perform, with respect to the disc 8 and under the thrust of a cam actuating device not shown, rectilinear displacements in the direction 11 itself.

The piston 28 is arranged, normally, at a given distance from the lower end of the cylinder 27 so as to define a dosing chamber 29 (FIGS. 2*d* and 2*i*), the volume of which s selectively controlled by way of the two cam actuating devices (not shown).

The wheel 5 comprises furthermore an annular container 30, which houses inside a powdered pharmaceutical product, is mounted above the units 9, and is rotatably coupled to the frame 6 to rotate in a continuous manner, with respect to the frame 6 itself, around a rotation axis 31 (FIG. 1) substantially parallel to, and distinct from, the mentioned axis 7 with an angular velocity substantially different from the angular velocity of the disc 8 and of the devices 26 around the axis 7 itself.

Following the eccentric mounting of the container 30 with respect to the disc 8, and during the displacement of the dosing device 26 from the station 20 to the station 21, the dosing chamber 29 first of all faces the container 30 so as to move axially from and towards the container 30 and withdraw a given quantity of pharmaceutical product from the container 30 itself, and therefore faces the respective pocket 19 so as to feed the just drawn pharmaceutical product inside the respective bottom 3.

In connection with the above, it should be clarified that the cylinder 27 and the piston 28 are advanced, normally, with respective laws of motion identical to one another in the direction 11 and the piston 28 is moved with respect to the cylinder 27 to compact the pharmaceutical product in the chamber 29, to transfer the pharmaceutical product from the chamber 29 in the respective bottom 3, and to form again the chamber 29 itself.

The operation of the machine 1 will now be described with reference to figures from 2*a* to 2*l*, taking into consideration a single pocket 19, and starting from an instant wherein the considered pocket 19 is fed through the input station 20 in phase with a seat 25 of the feeding wheel 22 containing an empty capsule 2 (FIG. 2*a*).

The capsule 2 is moved in the direction 11 from the seat 25 of the wheel 22 to the upper seat 18 of the considered pocket 19 by disconnecting the seat 25 from the device 22*a* and by connecting the pocket 19 itself with a pneumatic suction device 32.

The device 32 comprises a manifold 33 secured to the frame 6 around the axis 7 and, for each pocket 19, a respective conduit 34, which is formed through the disc 8 below the lower seat 10 of the pocket 19 itself, and which is suited to connect with the manifold 33 by the rotation of the wheel 5 around the axis 7.

The suction force exerted by the device 32 is selectively controlled so as to lower the capsule 2 from seat 25 into the pocket 19 and so open the capsule 2 itself by separating the bottom 3 from the cap 4.

Figure 2B:
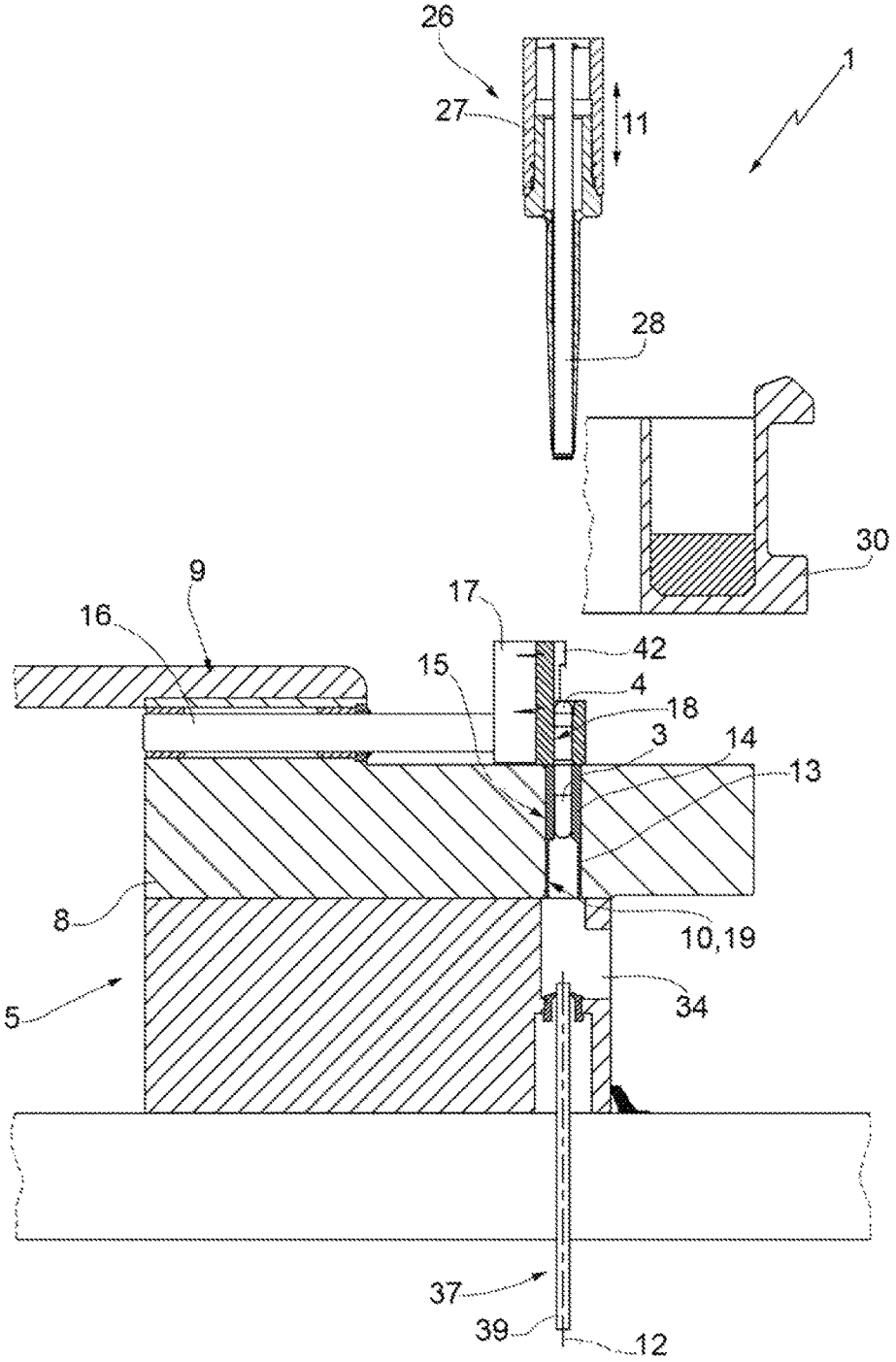

Following the opening of the capsule 2, the cap 4 is retained by the enlarged upper portion 18*a* of the seat 18, while the bottom 3 is advanced through the restricted lower portion 18*b* within the sleeve 13 to allow the measuring device 15 to measure the weight of the bottom 3 itself by way of its capacitive transducer 14 (FIG. 2*b*).

The weight detected by the device 15 allows, in addition, to verify the correct opening of the capsule 2. In particular, when the weight detected by the device 15 is less than the aforementioned reference value, the capsule 2 is not opened and the bottom 3 extends at least in part within the seat 18 and outside the seat 10.

Figure 2C:
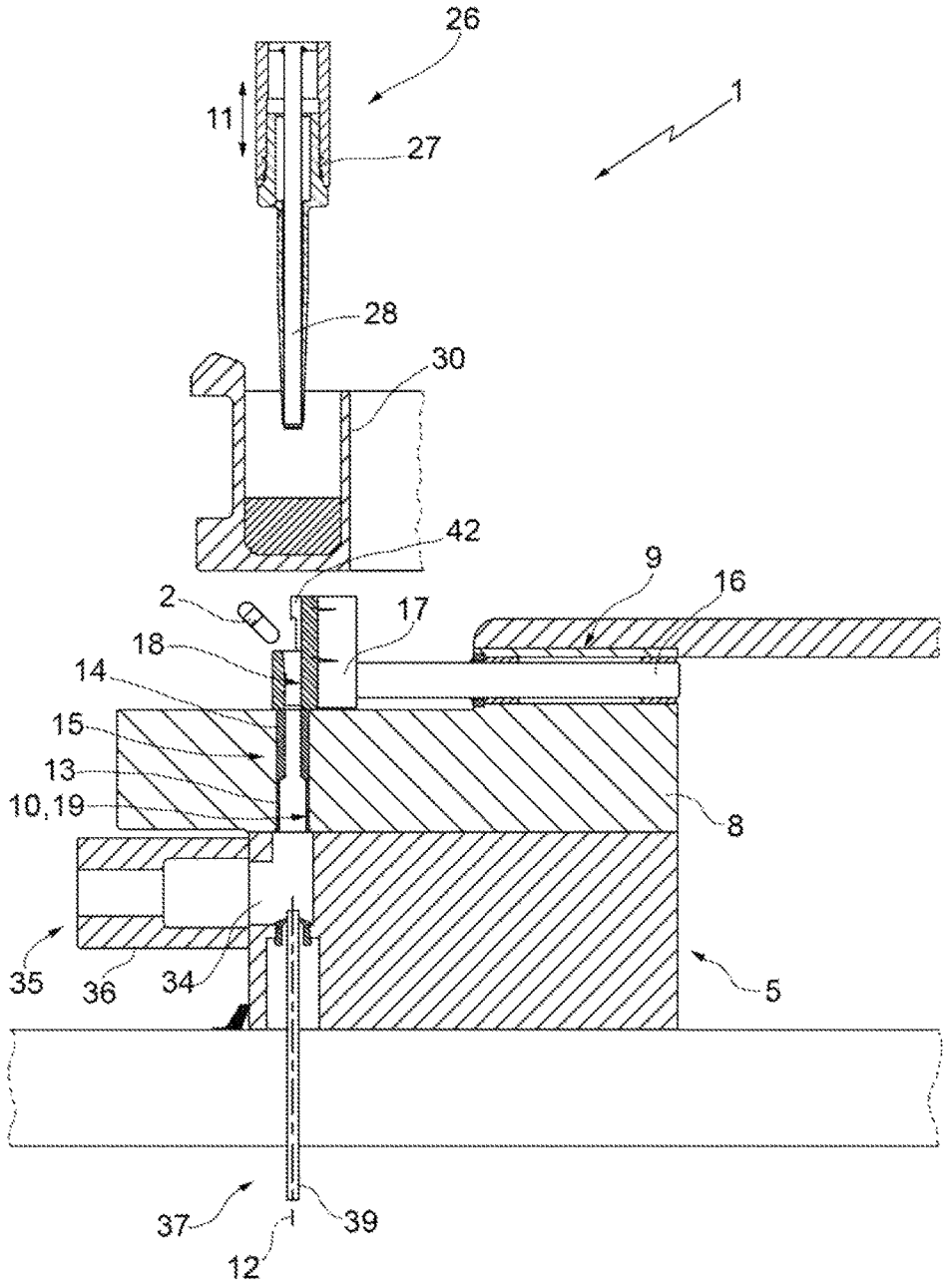

The capsule 2 which remained closed is discharged outside the pocket 19 connecting the conduit 34 with a pneumatic device 35 with compressed air, which comprises a manifold 36 secured to the frame 6 around the axis 7, and is activated selectively in response to a signal of the device 15 (FIG. 2*c*).

Figure 2D:
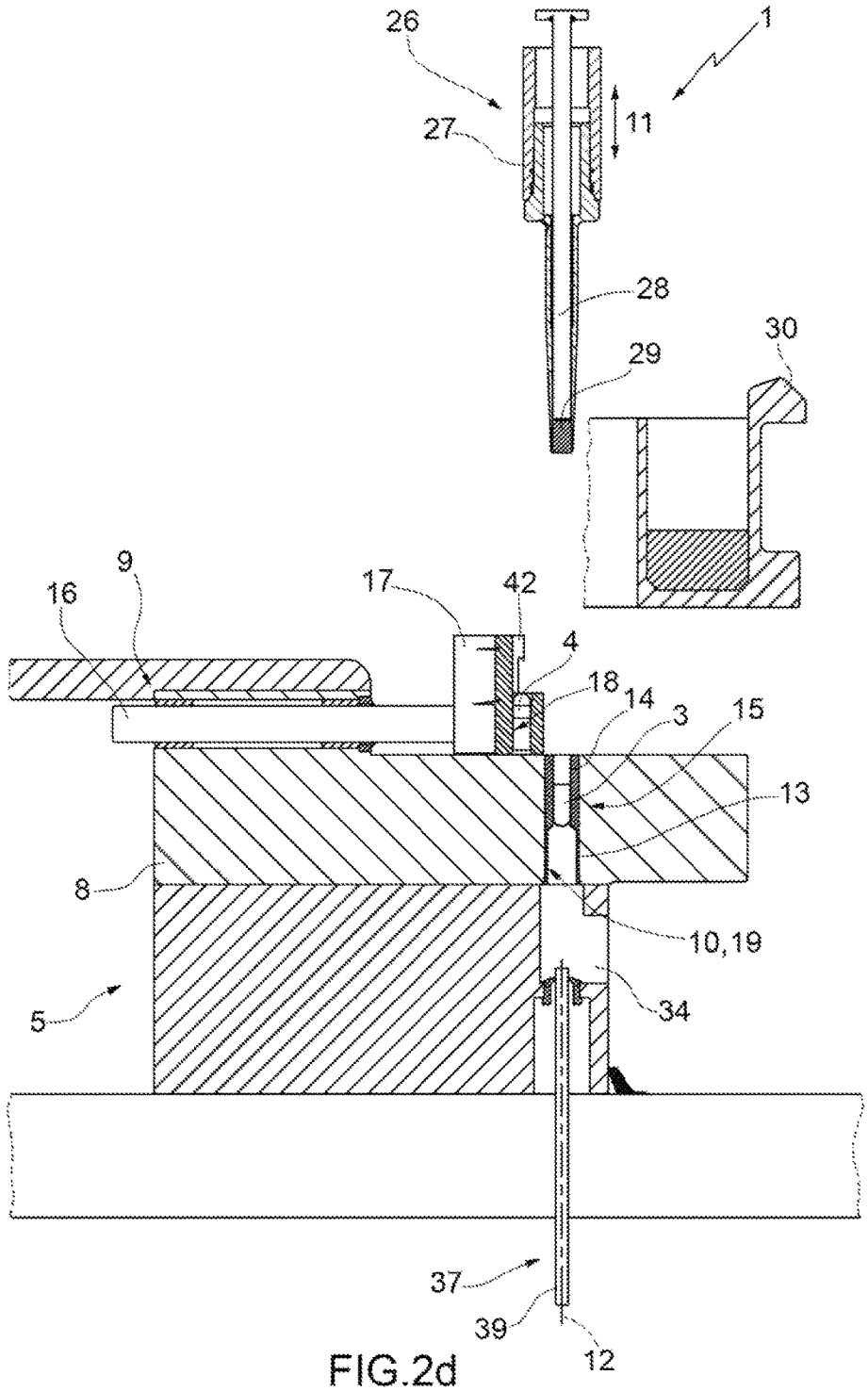
Figure 2E:
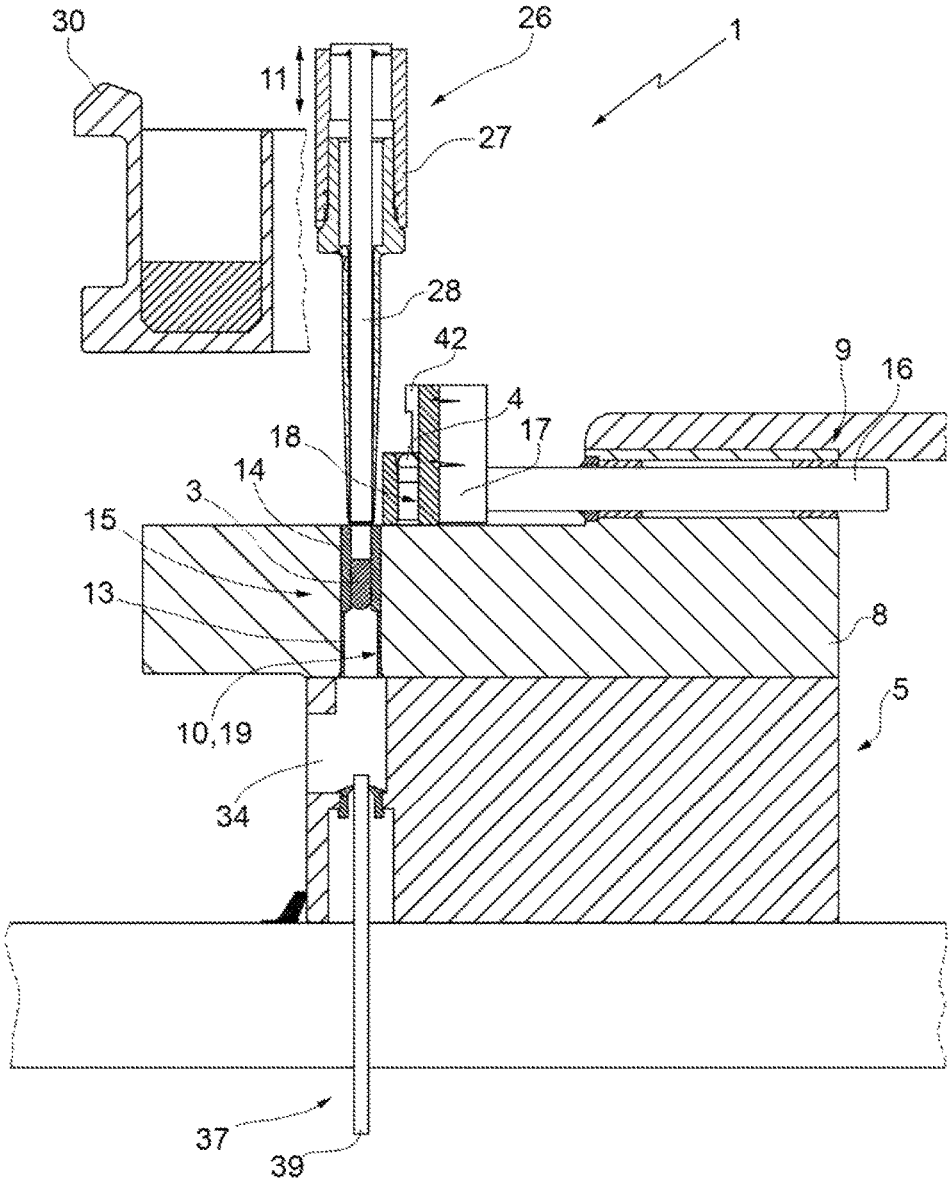

Once verified the correct opening of the capsule 2 and measured the weight of the bottom 3, the arm 16 is moved to its retracted position, the piston 28 of the respective dosing device 26 is moved with respect to the cylinder 27 to form the chamber 29, and the device 26 is first lowered into the container 30, and then disengaged from the container 30 in the same direction 11 to withdraw a given quantity of pharmaceutical product (FIG. 2*d*).

Figure 2F:
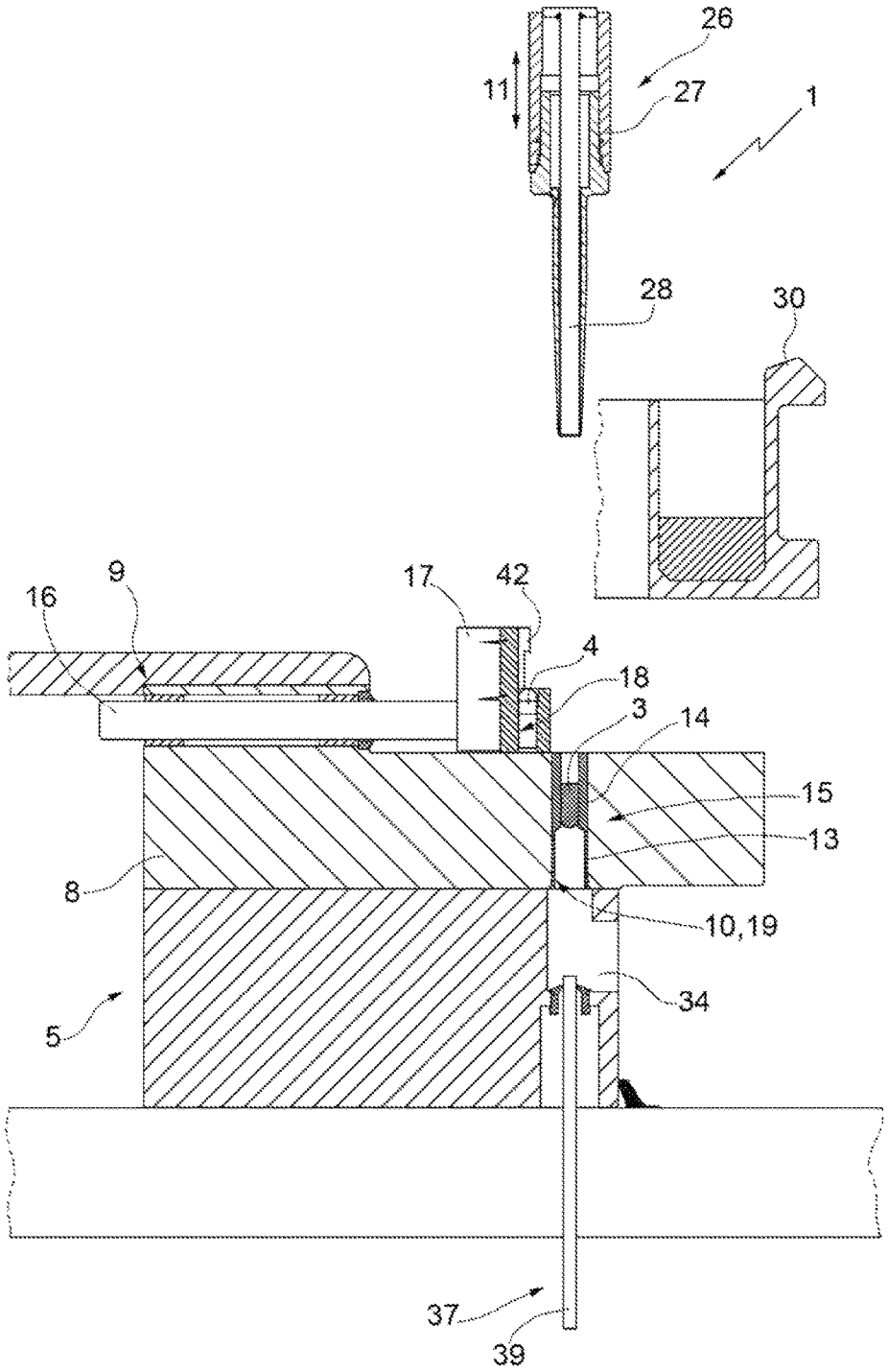

At this point, the device 26 is lowered again in the direction 11 to allow the piston 28 to discharge into the bottom 3 the pharmaceutical product contained in the chamber 29 (FIG. 2*e*), and the device 15 first of all measures the weight of the bottom 3 and the pharmaceutical product contained in the bushing 13 and, therefore, accurately calculates the weight of the pharmaceutical product fed into the bottom 3 as the difference between the two measurements (FIG. 2*f*).

Subsequently, the seat 18 is moved again in its forward position, and the capsule 2 is closed by means of a lower lifting device 37 and by an upper limit stop device 38.

As illustrated in FIG. 2, the device 37 is advanced by the dosing wheel 5 around the axis 7, and comprises a rod 39, which extends through the disc 8 in the direction 11, and is coupled in an angularly fixed and axially sliding manner to the disc 8 to perform, with respect to disc 8 and under the thrust of a cam actuating device, rectilinear displacements in the direction 11 itself.

Figure 2G:
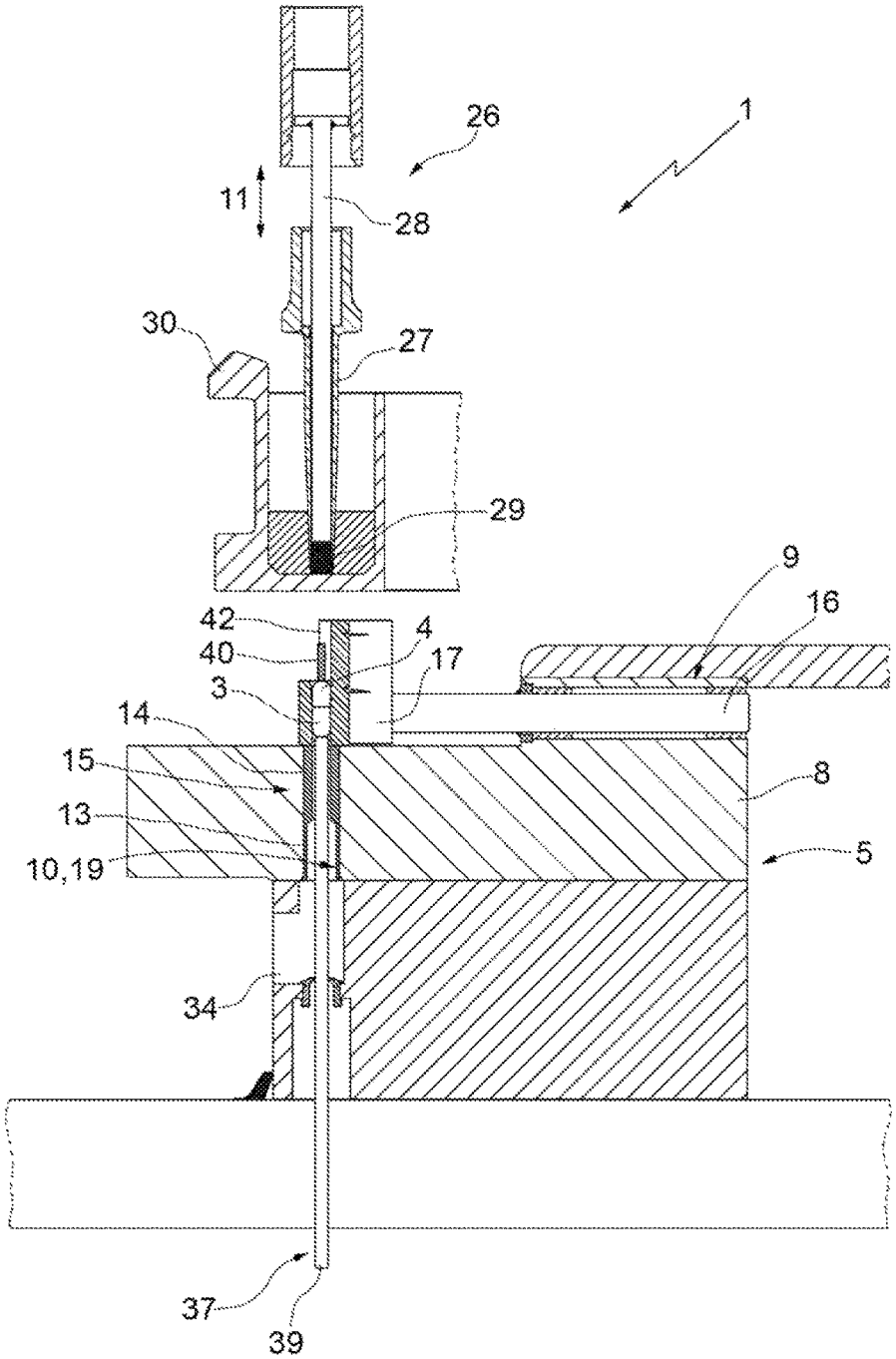

With reference to FIGS. 1 and 2*g*, the device 38 is mounted on the frame 6 in correspondence of a closing station of the capsules 2, and comprises a vertical belt 40 looped around a plurality of transmission pulleys (not shown) idly mounted to rotate around respective rotation axes (not shown) parallel to the direction 11.

The belt 40 extends above the pockets 18, and comprises a contrast portion 41, which is substantially tangent to the path P, and is locked in the upward direction 11 by an upper guiding bent panel 42 formed in each pick and place head 17.

The rod 39 is moved between a lowered position (FIG. 2*f*), in which the rod 39 is arranged substantially outside the seat 10, and an intermediate position (FIG. 2*g*), in which the rod 39 engages the bottom 3 and raises it, first of all, against the cap 4, and then against the lower edge of the belt 40 completing the closing of the capsule 2.

Figure 2H:
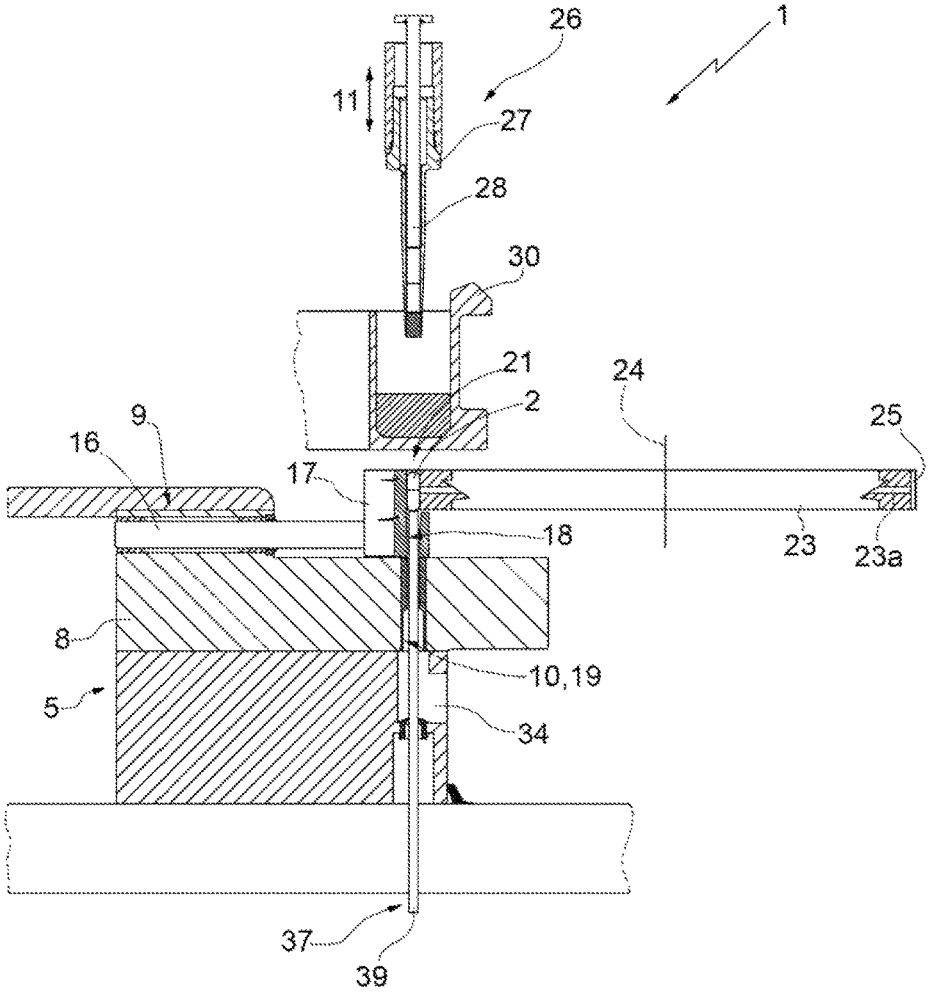

Finally, with reference to FIG. 2*h*, the pocket 19 is advanced through the output station 21 in phase with a seat 25 of the drawing wheel 23, and the rod 39 is moved from the intermediate position to a raised position for disengaging the capsule 2 from the pocket 19 and transfer it on the seat 25 of the wheel 23.

The machine 1 has some advantages mainly deriving from the fact that:

the housing of the bottoms 3 inside the lower seats 10 of the disc 8 allows the mounting of the bushing 13 within the seats avoiding any stress on the electrical wiring associated with the capacitive transducers 14;

the capsules 2 are closed using the idle belt 40, namely an upper closing member completely devoid of actuating devices; and the bushings 13 and the capacitive transducers 14 allow to accurately measure the weight of each pharmaceutical product fed within each capsule 2 and to verify both the correct opening of the capsules 2 and the presence of damaged capsules 2 inside the pockets 19.

The invention claimed is:

1. A continuous rotary machine for filling capsules with pharmaceutical products, each capsule comprising a bottom and a closing cap to close the bottom, the machine comprising:

at least one dosing wheel, which is mounted so as to rotate in a continuous manner around a rotational axis thereof that is parallel to a vertical direction, and which includes a plurality of pockets, wherein the plurality of pockets are distributed around said rotational axis and configured to each receive a respective capsule, each of the pockets comprising an upper seat, which is configured to receive and hold a cap of said respective capsule, and a lower seat, which is arranged under the upper seat and configured to receive and hold a bottom of the respective capsule, wherein the upper seat of each of the pockets is radially mobile between a forward position, in which the upper seat is aligned with a respective lower seat in said vertical direction, and a retracted position, in which the upper seat and the respective lower seat are staggered with respect to each other in the vertical direction, each lower seat having a measuring device to measure one of a weight of the bottom of the respective capsule and a combined weight of the bottom of the respective capsule and a pharmaceutical product contained in the bottom of the respective capsule, and wherein the at least one dosing wheel further comprises a plurality of dosing devices which are configured for alignment with each of the pockets and which are mobile along a path so as to feed a quantity of pharmaceutical product into the bottom of the respective capsule contained in a respective pocket.

2. The continuous rotary machine according to claim 1, wherein the at least one dosing wheel comprises a feeding disc, which includes the lower seats, and a plurality of pick and place arms that are distributed around said rotational axis, each of the arms including a respective upper seat and being radially mobile above the feeding disc in order to move the respective upper seat of each of the arms between the forward position and the retracted position.

3. The continuous rotary machine according to claim 1, further comprising a container, which houses in an inside thereof the pharmaceutical product, which is rotatably mounted above the pockets of the at least one dosing wheel, and which extends around a longitudinal axis thereof that is parallel to and distinct from said rotational axis, wherein in a first state, a respective one of the dosing devices draws a given quantity of the pharmaceutical product from the container at a drawing station, and then, in a second state, the respective one of the dosing devices moves along a portion of the path in phase with the bottom of the respective capsules and transfers the pharmaceutical product into the bottom of the respective capsules.

4. The continuous rotary machine according to claim 1, wherein the at least one dosing wheel further comprises an opening station to open the capsules, a closing station to close the capsules, an upper limit stop device, which is mounted along the path, and a lower lifting device which is mobile and arranged in the vertical direction in each of the pockets, so as to lift the bottom and the cap contained in the respective pocket against the upper limit stop device and close the respective capsule.

5. The continuous rotary machine according to claim 4, wherein the upper limit stop device comprises a belt, which is mounted above the pockets and at least partially extends tangential to the path.

6. The continuous rotary machine according to claim 5, wherein the belt is wound in a ring shape around a plurality of idle pulleys.

7. The continuous rotary machine according to claim 5, wherein the belt extends in the vertical direction.

8. The continuous rotary machine according to claim 7, wherein each of the pockets has an upper guiding bent panel thereon for locking the belt upwards in said vertical direction.

9. The continuous rotary machine according to claim 1, wherein the measuring device comprises at least one capacitive transducer.

10. The continuous rotary machine according to claim 1, wherein the measuring device axis, are configured to at least partially defines said lower seat; and at least one capacitive transducer.

11. The continuous rotary machine according to claim 1, wherein the at least one dosing wheel further comprises an opening station to open the capsules, and an expelling device which is mounted along the path downstream of the opening station in a feeding direction of the at least one dosing wheel around said rotational axis and is selectively activated in response to a signal of the measuring device of a pocket so as to disengage a closed capsule from the pocket.

12. The continuous rotary machine according to claim 1, wherein the at least one dosing wheel includes a container that houses said pharmaceutical product and which continuously rotates around a rotation axis that is parallel to and distinct from the rotational axis of said at least one dosing wheel.

13. The continuous rotary machine according to claim 2, wherein the at least one dosing wheel includes a container that houses said pharmaceutical product and which continuously rotates around a rotation axis that is parallel to and distinct from the rotational axis of said at least one dosing wheel.

14. The continuous rotary machine according to claim 13, wherein said container continuously rotates with an angular velocity different from an angular velocity of said feeding disc.

15. The continuous rotary machine according to claim 1, wherein each upper seat comprises an enlarged upper portion having a first width and a restricted lower portion having a second width, wherein the second width is smaller than the first width.

16. The continuous rotary machine according to claim 1, wherein adjacent pockets are spaced equidistant from each other.

17. A continuous rotary machine for filling capsules with pharmaceutical products, each of said capsules comprising a bottom and a closing cap to close the bottom, the machine comprising:

at least one dosing wheel, which is mounted so as to rotate in a continuous manner around a rotational axis thereof that is parallel to a vertical direction, and which includes a plurality of pockets, wherein the plurality of pockets are distributed around said rotational axis, are configured to each receive a respective capsule, and are fed by the dosing wheel along a given path, each of the pockets comprising an upper seat, which is configured to receive and hold a cap of the respective capsule, and a lower seat, which is arranged under the upper seat and configured to receive and hold a bottom of the respective capsule, wherein each upper seat is radially mobile between a forward position, in which the upper seat is aligned with a respective lower seat in said vertical direction, and a retracted position, in which the upper seat and the respective lower seat are staggered with respect to each other in the vertical direction, each lower seat being provided with a measuring device to measure either a weight of the bottom of the respective capsule or a combined weight of the bottom of the respective capsule and a pharmaceutical product contained in the bottom of the respective capsule, wherein the at least one dosing wheel comprises a feeding disc, which is provided with the lower seats, and a plurality of pick and place arms, which are distributed around said rotation axis, which are each provided with a respective upper seat, and which are radially mobile above the feeding disc in order to move the respective upper seats between the forward positions and the retracted positions, wherein the at least one dosing wheel includes a container that houses said pharmaceutical product and which continuously rotates around a rotation axis that is parallel to and distinct from the rotational axis of said at least one dosing wheel, wherein said container continuously rotates with an angular velocity different from an angular velocity of said feeding disc, and wherein the at least one dosing wheel further comprises a plurality of dosing devices which are configured for alignment with each of the pockets and which are mobile along the path so as to feed a quantity of pharmaceutical product into the bottom of the respective capsule contained in a respective pocket.

* * * * *